US007503459B2

(12) United States Patent
Grayson

(10) Patent No.: US 7,503,459 B2
(45) Date of Patent: Mar. 17, 2009

(54) DEVICE FOR STORING FISHING RODS AND OTHER TOOLS

(75) Inventor: Jeremy Grayson, Chaska, MN (US)

(73) Assignee: Normark Innovations, Inc.

( * ) Notice: Subject to any disclaimer, the term of this patent is extended or adjusted under 35 U.S.C. 154(b) by 371 days.

(21) Appl. No.: 11/115,494

(22) Filed: Apr. 27, 2005

(65) Prior Publication Data

US 2006/0243686 A1 Nov. 2, 2006

(51) Int. Cl.
*A47F 7/00* (2006.01)

(52) U.S. Cl. ..... 211/70.8

(58) Field of Classification Search ..... 211/70.8, 211/66, 63, 67, 68, 124, 70.6, 61.1
See application file for complete search history.

(56) References Cited

U.S. PATENT DOCUMENTS

| | | | | | |
|---|---|---|---|---|---|
| 243,898 | A | * | 7/1881 | Hill, Jr. | 248/113 |
| 1,174,185 | A | * | 3/1916 | Scott | 211/68 |
| 1,609,666 | A | * | 12/1926 | Settevig | 248/113 |
| 1,719,360 | A | * | 7/1929 | Deike | 211/68 |
| 3,674,190 | A | | 7/1972 | Wright | |
| 4,003,612 | A | | 1/1977 | Munsell | |
| 4,014,466 | A | * | 3/1977 | Wess et al. | 294/162 |
| D248,347 | S | | 7/1978 | McCollum | |
| 4,133,131 | A | | 1/1979 | Davy | |
| D256,303 | S | | 8/1980 | Rieman | |
| 4,311,262 | A | | 1/1982 | Morin | |
| 4,529,112 | A | | 7/1985 | Miller | |
| 4,582,203 | A | | 4/1986 | Davis | |
| 4,696,122 | A | | 9/1987 | Van Der Zyl | |
| 4,739,914 | A | | 4/1988 | Pothetes | |
| 4,779,914 | A | | 10/1988 | Friedline | |
| 4,798,298 | A | * | 1/1989 | Ursetta | 211/70.5 |
| 4,986,427 | A | | 1/1991 | Law et al. | |
| 5,183,164 | A | * | 2/1993 | Heinzle | 211/70.5 |
| 5,347,746 | A | | 9/1994 | Letson | |
| 5,588,542 | A | * | 12/1996 | Winkler et al. | 211/70.8 |
| 5,601,196 | A | * | 2/1997 | Heer et al. | 211/65 |
| 5,625,973 | A | | 5/1997 | Anthony | |
| 5,678,700 | A | | 10/1997 | Crosson, Jr. | |
| 6,412,735 | B1 | * | 7/2002 | Mathieu | 248/110 |
| 6,487,814 | B1 | | 12/2002 | Arredondo et al. | |
| 6,595,376 | B1 | * | 7/2003 | Lin | 211/70.6 |

* cited by examiner

*Primary Examiner*—Sarah Purol
(74) *Attorney, Agent, or Firm*—Dority & Manning, P.A.

(57) ABSTRACT

A device for storing fishing rods, sporting equipment, and other tools is disclosed. The device comprises a housing defining at least one opening. A pair of holding elements is located substantially within each opening. Each holding element is attached to said housing and is movable between an open position and a closed position. A pair of biasing elements is in contact with said housing and said holding elements. The pair of biasing elements is configured so as to urge said holding elements towards one another.

4 Claims, 4 Drawing Sheets

DEVICE FOR STORING FISHING RODS AND OTHER TOOLS

TECHNICAL FIELD OF THE INVENTION

The present invention relates generally to a device for holding, storing, or displaying fishing rods, sporting goods, and other tools and equipment. For example, the present invention can be useful in organizing and storing fishing rods and other equipment in a house, garage, workshop, on a boat, or in a retail store as a display device. In one exemplary embodiment of the present invention, an apparatus is provided that is particularly useful for storing fishing rods.

BACKGROUND OF THE INVENTION

Persons owning tools often search for a convenient storage system to maximize the use of space and organize their equipment. This is especially true when applied to persons seeking to store and organize sporting equipment, such as fishing and hunting equipment. In particular, outdoorsmen have a special need for storing their gear in an organized and accessible manner. For instance, fishermen need a convenient and localized place for storing fishing rods.

Also, according to the various needs or preferences of the person, one wishing to store tools may desire a storage device capable of being utilized in many different environments. For instance, many persons may desire to mount a tool storage device on the wall of their garage or workstation to organize their tools while keeping them accessible. Alternatively, the storage device could be mounted along the gunwale of a boat or inside the cabin of a boat to keep tools out of the way of the boaters but readily accessible for use.

Many persons may want to store their tools against a wall or ceiling, so the storage device should be able to grip and/or hold the tool in the storage device against gravitational forces. However, a user of the tool should be able to easily retrieve the tool from the storage device when desired.

Previous storage devices incorporate undesired characteristics that can adversely affect the capacity of the storage device. For instance, many previous storage devices employ the use of foam or a foam like soft material to grip the tool being stored. However, over time, foam or a similar soft material can develop a memory as to the size and shape of the stored tool. This memory can cause problems when later attempting to store a tool that is smaller than the originally stored tool because the foam may not be able to grip the smaller tool.

Also, many other devices employ the use of straps or ties to hold the tool in the storage device. However, these straps or ties are not convenient to use. A more convenient device would not employ the use of straps or ties. Accordingly, the present invention, in one embodiment, can effectively hold the tools being stored by the storage device without the use of straps or ties.

A need currently exists for a storage device capable of storing tools of various sizes and sizes while being versatile enough to be placed in various environments that the user should desire. The storage device should be able to keep the tools stored out of the way of the user but still conveniently accessible to the user. Additionally, the storage device should be able to withstand normal use without substantial wear and/or the previously described memory problem that affect the overall ability to store tools.

THE SUMMARY OF THE INVENTION

Objects and advantages of the invention will be set forth in part in the following description, or may be obvious from the description, or may be learned through practice of the invention.

Generally, the present disclosure provides for a storage device or apparatus useful for storing fishing rods, sporting goods including fishing and hunting equipment, and other tools and equipment. In one embodiment, the present disclosure provides for a storage device comprising a housing that defines at least one opening. Located substantially within the opening is a pair of holding elements that are pivotally attached to the housing and movable between an open position and a closed position. Also, a pair of biasing elements are in contact with the housing and the holding elements so as to urge the holding elements towards one another.

In some embodiments, each holding element can define an interlockable member, such as more than one interlockable member. The interlockable members can be configured to overlap with each other when the holding elements are in the closed position. Furthermore, the interlockable members can be shaped to allow the holding elements to move from the closed position to the open position upon the insertion of the tool.

In other embodiments, any means for selectively interlocking the pair of holding elements when in the closed position yet still allowing the pair of holding elements to move to an open position upon the insertion of the tool can be utilized.

In one exemplary embodiment, the biasing elements are springs that are in contact with the housing and the holding elements so as to urge the holding elements towards one another.

The storage device can also be capable of being attached to a mounting surface. As such, any means for attaching the housing to a mounted surface can be utilized. In one exemplary embodiment, the housing can define at least one aperture allowing a screw to be inserted into the aperture to attach the housing to a mounting surface.

In another exemplary embodiment, the present disclosure teaches an apparatus for storing tools comprising a housing that defines at least one opening. Within the opening, a first jaw member is movably attached to the housing. Also, a second jaw member is attached to the housing within the opening and positioned relative to the first jaw member so as to provide for the selective inserting or removal of the tool from between the first and second jaw members. Additionally, a first spring is positioned to bias the first jaw member toward the second jaw member. In one embodiment, each of the jaw members also includes at least one tooth.

In yet another exemplary embodiment, the present disclosure provides for an apparatus comprising a housing defining at least one opening. Located substantially within the opening is a pair of holding elements that are attached to the housing so as to be movable between an open position and a closed position. A pair of springs are positioned in contact with the holding elements so as to force the holding elements towards one another within the opening. Also, one or more interlocking members are positioned on each holding element such that the interlocking members overlap when the holding elements are in a closed position.

In yet another exemplary embodiment, a holder for storing fishing rods on a flat surface is disclosed comprising a first housing and a second housing. The first housing defines at least one opening. A pair of holding elements are located substantially within the opening and are attached to the first housing such that the holding elements are movable between an open and a closed position. A pair of springs are positioned in contact with the holding elements so as to force the holding elements towards one another. Furthermore, one or more interlocking members are positioned on each holding element such that the interlocking elements overlap when the holding elements are in a closed position. The second housing defines a top panel and a bottom panel. The top panel defines the same number of openings as included in the first housing. The bottom panel provides additional support for the storing of the fishing rods.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in this specification, which makes references to the appended figures, in which.

Figure 1:
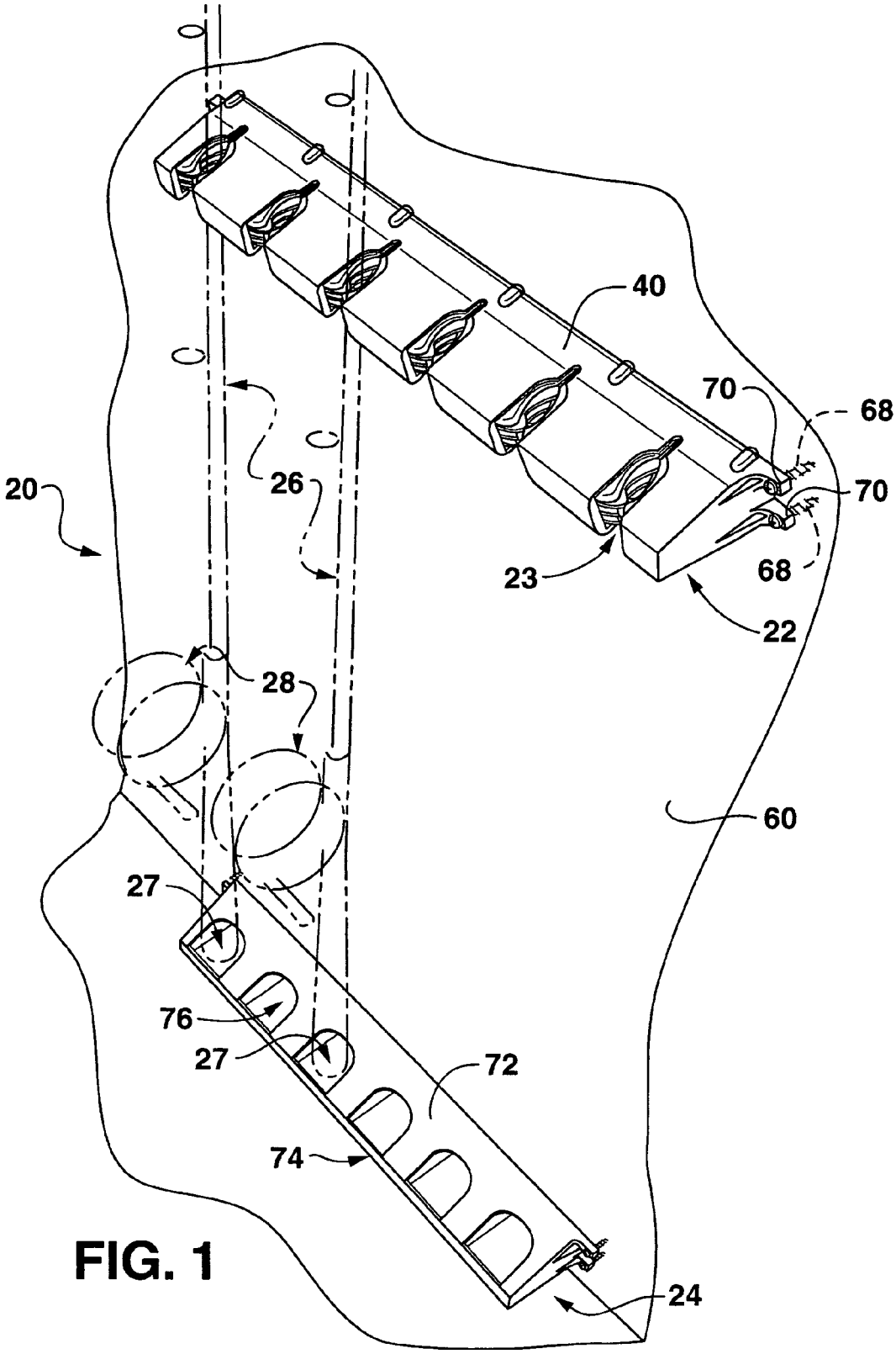
FIG. 1 is a perspective view of an exemplary embodiment of the present invention including a two piece storage device particularly suitable for the storage of fishing rods.

Repeat use of reference characters in the present specification and drawings is intended to represent same or analogous features or elements of the invention.

DETAILED DESCRIPTION

The present application generally provides an apparatus for holding, storing, or displaying fishing rods, sporting equipment, and other tools and equipment.

In order to fully understand the advantages of the present disclosure, FIGS. 1-4 will be explained in greater detail as exemplary embodiments of the present invention. Each example is provided by way of explanation of the invention, and not meant as a limitation of the invention. For example, features illustrated of described as part of one embodiment can be used with another embodiment to yield still a third embodiment. It is intended that the present invention include these and other modifications and variations.

Exemplary embodiments of the present invention and exemplary components thereof are depicted in FIGS. 1-4. A two-piece storage device 20 is shown comprising holder 22 and support apparatus 24. Storage device 20 is shown storing fishing rods 26 with reels 28. Holder 22 defines openings 23. Within each opening 23, holder 22 includes jaw-like holding elements 30 and 32, which hold and retain fishing rod 26. Teeth-like interlocking members 34 and 36 are defined by holding elements 30 and 32, which help to hold and retain fishing rod 26. In another exemplary, such as the embodiment shown in FIG. 3, holding elements 30 and 32 can hold and retain pliers 38. In still other embodiments, holding elements 30 and 32 can be utilized to store any tool, including hunting and fishing equipment.

In the exemplary embodiments depicted in FIGS. 1-4, holding element 30 defines two interlocking members 34, while holding element 32 defines three interlocking members 36. As shown, interlocking members 34 are positioned to interlock, overlap and alternate with interlocking members 36 when holding elements 32 and 34 are in a closed position.

Figure 2:
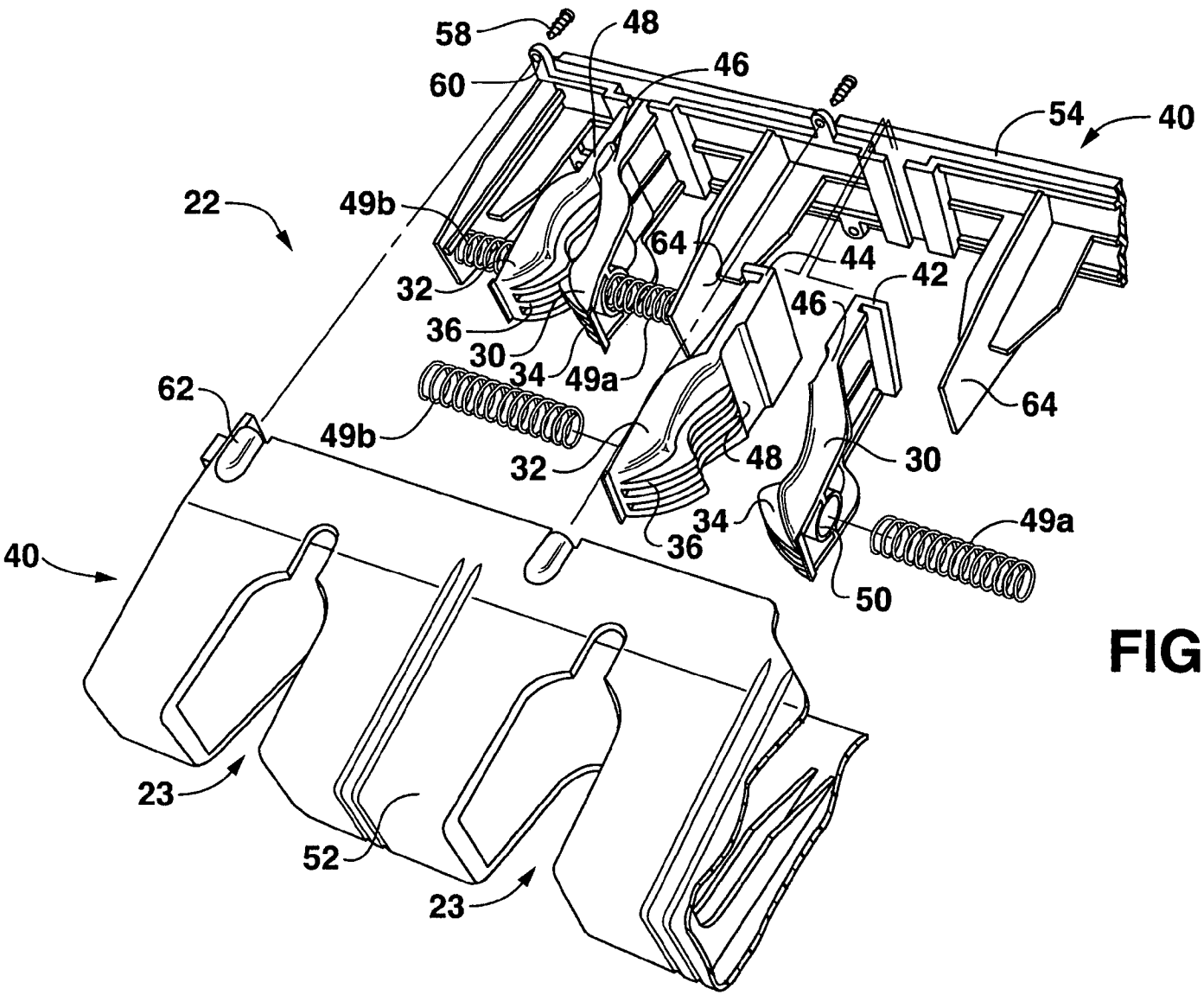
FIG. 2 is an exploded, partial view of an exemplary embodiment of the present invention.

Referring to FIG. 2, springs 49*a* and 49*b* are positioned in contact with holding elements 30 and 32, respectively, to bias or force holding elements 30 and 32 towards each other. Holding element 30 defines a spring acceptor 50 which maintains spring 49*a* in contact with holding element 30 to provide a constant force biasing holding element 30 toward holding element 32. A similar arrangement is provided to bias holding element 32 towards element 30.

As FIG. 2 shows, holding elements 30 and 32 are pivotally attached to a housing 40 allowing holding elements 30 and 32 to move between a closed position and an open position. As used herein, "pivotally attached" means that at least some portion of the holding element 30 or 32 is movable relative to housing 40. Holding elements 30 and 32 define bracket members 42 and 44, respectively, which are connected or attached housing 40. Bracket members 42 and 44 do not move relative to housing 40; however, holding elements 30 and 32 can still move between an open and closed position because holding elements 30 and 32 are somewhat flexible in first flexible pivot area 46 and second flexible pivot area 48, respectively. In this embodiment, flexible pivot areas 46 and 48 have a smaller thickness than the rest of holding elements 30 and 32, allowing holding elements 30 and 32 to bend or flex between an open and closed position.

Housing 40 is shown as a two-piece construction comprising a first housing assembly piece 52 and second housing assemble piece 54. First housing assembly piece 52 defines openings 23. First housing assembly piece 52 also covers the inner parts of holder 22, such as spring 49 and other components.

Second housing assembly piece 52 of housing 40 defines inner housing spring support members 64. Spring 49*a* is in contact with both holding element 30 and an inner housing spring support member 64 to urge or bias holding element 30 toward holding element 32. Also, as shown, spring 49*b* is in contact with holding element 32 and another inner housing support member 64 to urge holding element 32 toward holding element 30. Therefore, each holding element 30 and 32 are biased toward each other creating a jaw-like apparatus capable of holding and retaining a tool that is inserted into the jaw.

First housing assembly piece 52 is connected to second housing assembly piece 54 through the use of screws 58. Screws 58 are inserted through screw apertures 60 defined by second housing assembly piece 54 and into screw acceptors 62 located on first housing assembly piece 52.

Figure 3:
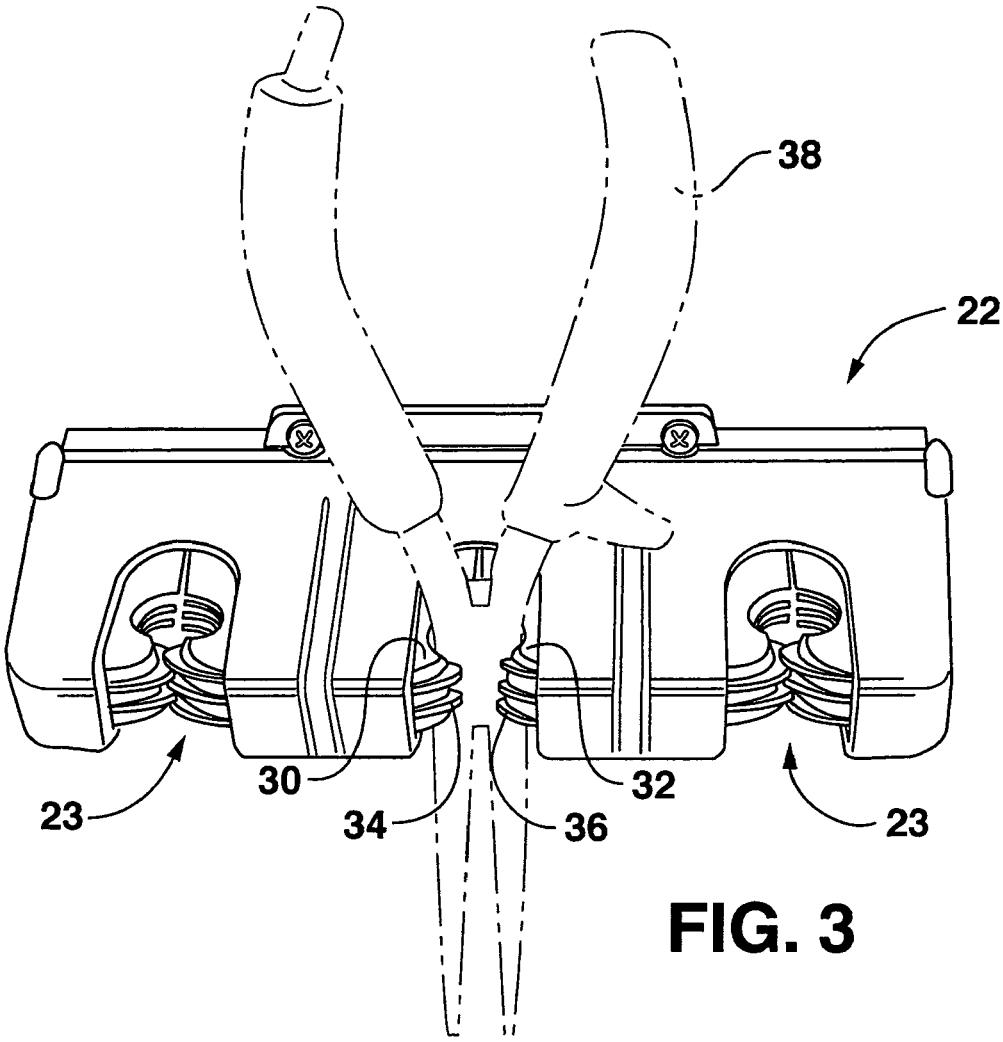
FIG. 3 is a top view of still another exemplary embodiment of the present invention.

FIGS. 1 and 3 depict one exemplary embodiment of the present invention wherein holder 22 is attached to surface 66 by the use of mounting screws 68. Mounting screws 63 are inserted through mounting apertures 70 defined by holder 22 and into surface 66. Surface 66 can be a wall, ceiling, floor, gunwale or any other surface capable of accepting holder 22. However, any method of attachment or mounting holder 22 onto surface 66 can be used. In deciding the manner of attaching holder 22 to surface 66, many factors should be weighed, including but not limited to the outer finish of surface 66, the strength of surface 66, the weight of the tools to be stored in holder 22, and the like. For example, holder 22 can be attached to surface 66 by any method including, but not limited to, an adhesive, a hook-and-loop fastener, a magnet, a screw, a hook, tape, snaps, or any combination thereof.

Holder 22 can generally be utilized to store tools, including sporting equipment. Sporting equipment can be any type of fishing and hunting equipment including, but not limited to, fishing rods, gaffs, fishing pliers, hook removal tools, scales, guns, knives, arrows, bows, and the like. For instance, in one exemplary embodiment, FIG. 1 depicts fishing rods 26 stored in two piece storage device 20 comprising holder 22 and support apparatus 24. In another exemplary embodiment, FIG. 3 depicts pliers 38 stored in holder 22.

Figure 4A:
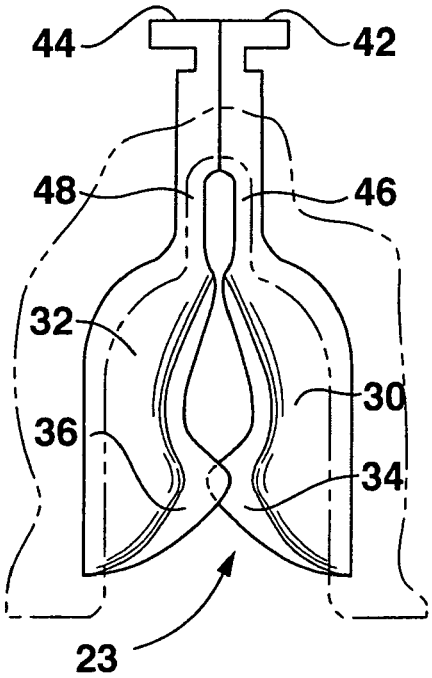
FIGS. 4A-4C are top views of exemplary components of the present invention.
Figure 4B:
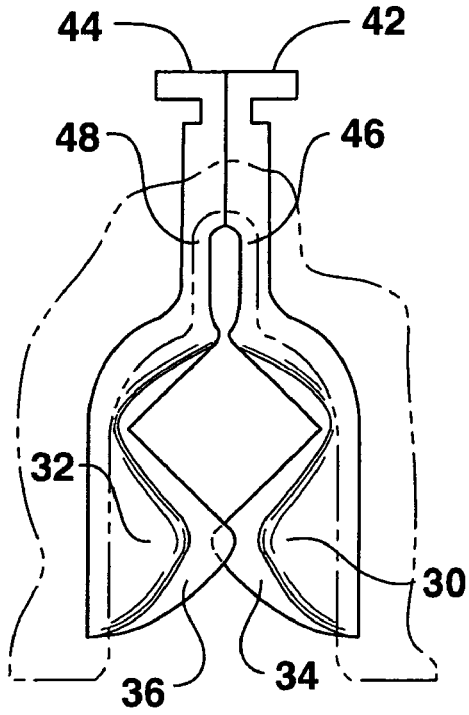
Figure 4C:
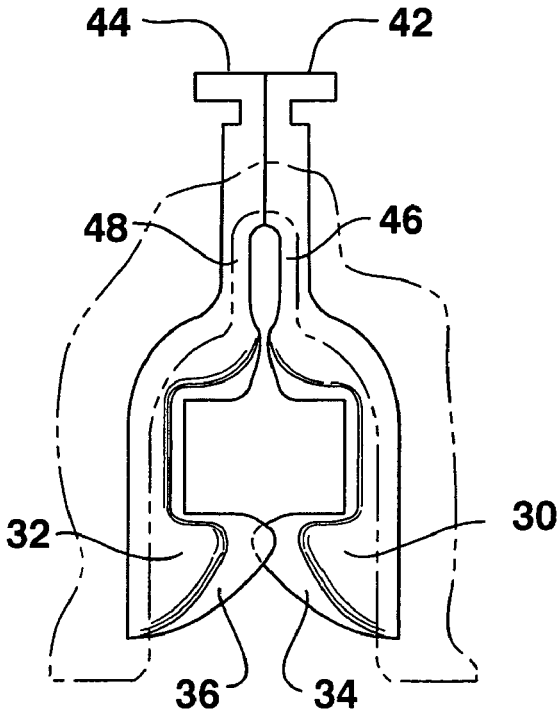

Holding elements 30 and 32 and/or interlocking members 34 and 36 can be shaped to accommodate tools of different shapes and sizes. For instance, FIGS. 4A-C represent only exemplary embodiments of the different shapes that can be defined by the pair of holding elements 30 and 32 and interlocking members 34 and 36. One skilled in the art would recognize that the type, shape, and/or size of the tool to be stored, as well as other factors, can influence the desired shape of holding elements 30 and 32 and/or openings 23 and/or interlocking members 34 and 36.

Depending on the size and shape of the tool interlocking members 34 and 36 may or may not overlap while storing the tool. However, even if the interlocking members 34 and 35 do not overlap while the tool is being stored, interlocking members 34 and 36 can still prevent the tool from inadvertently escaping holder 22. For instance, interlocking members 34 and 36 can be shaped to effectively prevent an inserted tool from inadvertently falling out of holder 22. FIGS. 1-4 depict different shapes of interlocking members 34 and 36 that can effectively hold a stored tool even when interlocking members 34 and 36 do not overlap when holding the tool.

Holding elements 30 and 32 and/or interlocking members 34 and 36 can also be shaped to allow movement between an open position and a closed position automatically upon insertion or removal of the tool. As such, without a tool present in holder 22, holding elements 30 and 32 are biased toward one another and are at rest in a closed position, allowing interlocking members 34 and 36 to form an interlocking jaw. However, when a tool is inserted into opening 23, holding elements 30 and 32 and interlocking members 34 and 36 are pushed to an open position to allow insertion of the tool. Upon complete insertion of the tool, holding elements 30 and 32 and interlocking members 34 and 36 hold and retain the tool through the biasing force applied to holding elements 30 and 32.

Holding elements 30 and 32 and interlocking members 34 and 36 can be manufactured from any material capable of being formed into the desired shape. For example, holding elements 30 and 32 can comprise a plastic material, a rubber material, a metallic material, a wood or wood based material, or any combination or mixtures thereof. Interlocking members 34 and 36 can be defined by holding elements 30 and 32 and can comprise the same or different composition as holding elements 30 and 32. Also, interlocking members 34 and 36 can be attached to holding elements 30 and 32, instead of being defined by holding elements 30 and 32.

Both holding elements 30 and 32 can be attached to housing 40 in any manner, such that at least one of the holding elements 30 and/or 32 are attached pivotally, allowing movement between a closed position and an open position. FIGS. 2 and 4 depict one exemplary embodiment of holding elements 30 and 32 including a first flexible pivot area 46 and second flexible pivot area 48. First and second flexible pivot areas 46 and 48 allow holding elements 30 and 32, respectively, to move or flex between an open and a closed position even when bracket members 42 and 44 are attached in a stationary manner to housing 40. In the depicted embodiment, first and second flexible pivot areas 46 and 48 comprise the same material as holding elements 30 and 32. Alternatively, in another embodiment, first and second flexible pivot areas 46 and 48 can comprise a different material than holding elements 30 and 32. For example, first and second flexible pivot areas 46 and 48 can comprise a more flexible material than the rest of holding elements 30 and 32. For instance, holding elements 30 and 32 can comprise a plastic material and first and second flexible pivot areas 46 and 48 can comprise a more flexible material, such as a rubber.

The exemplary embodiment depicted in FIG. 2 shows that both holding elements 30 and 32 are securely attached to housing 40 by bracket members 42 and 44. However, in alternative embodiments, bracket members 42 and 44 can be attached by other means to second housing assembly piece 54 to allow holding elements 30 and 32 to move between an open and a closed position even when holding elements 30 and 32 are relatively stiff. For example, one or both holding elements 30 and 32 could be attached to housing 40 using a pin and aperture combination to provide for a pivoting movement. By way of further example, first holding element 30 can be pivotally attached to housing 40 while second holding element 32 is attached or fixed to housing 40. In this embodiment, only one holding element 30 or 32 is movable between an open and a closed position. As such, the jaw formed by holding elements 30 and 32 is movable between an open and a closed position, even though only one of the holding elements 30 or 32 is actually moving.

Also, holding elements 30 and 32 can be biased or forced toward each other by the use of any suitable biasing element. For example, FIG. 2 represents one exemplary embodiment where the biasing element is a spring 49. However, in other embodiments, other suitable biasing elements can be employed, including, but not limited to, multiple springs, plastic tabs, and other mechanisms. In another embodiment, holding elements 30 and 32 can be designed, through shape and/or composition, to act as their own biasing force. In this embodiment, one or both of holding elements 30 and 32 would include a biasing element such as a plastic finger or the like that urges the elements towards one another.

As discussed above, in the exemplary embodiment depicted in FIGS. 1-4, holding element 30 defines three interlocking members 34, while holding element 32 defines two interlocking members 36. Interlocking members 34 are positioned to interlock with interlocking members 36 when holding elements 30 and 32 are in a closed position. However, in other embodiments, any number of interlocking members 34 and 36 can be positioned on holding elements 30 and 32 respectively. For example, in some embodiments, at least one interlocking member can be positioned on each of the holding elements. In other exemplary embodiments, holding elements 30 and 32 can be constructed without any interlocking members 34. In such embodiments, holding elements 30 and 32 would be shaped to assist with opening, closing, and holding the tool.

The number of openings 23 defined by housing 40 is dependent on the number of tools desired to be stored by holder 22 and the space available on surface 66 for holder 22. Any number of openings 23 can be defined by housing 40 as long as at least one opening 23 is defined by housing 40. For example, FIG. 1 depicts housing 40 defining six openings 23. In another example, FIG. 2 depicts housing 40 defining at least two openings. In another exemplary embodiment, FIG. 3 shows housing 40 defining three openings 23. In some other embodiments, holder 22 can have only one opening 23.

The exemplary embodiments depicted in FIGS. 1-4 all show opening 23 as being a double-U shaped opening defined by housing 40. However, the size and shape of opening 23 can vary according to the particular application to which holder 22 is directed. One skilled in the art can weigh several factors to determine the size and shape of opening 23 including, but not limited to, the size, shape, weight, and texture of the tool. In some embodiments, when housing 40 defines more than one opening 23, all of the openings 23 can be the same size and shape. However, in other embodiments, the size and shape of openings 23 can vary along housing 40. Also, when more than one opening 23 is defined by housing 40, the distance between the openings 23 can vary according to the particular application to which holder 22 is directed. Several factors can be weighed in determining the distance between openings 23 including, but not limited to, the size and shape of the tools and the available space for holder 22.

FIG. 2 depicts one exemplary embodiment where housing 40 comprises first housing assembly piece 52 and second housing assemble piece 54. In the embodiment shown in FIG. 2, first housing assembly piece 52 is optional because holder 22 would still function without the presence of first housing assembly piece 52. In such an embodiment, holder 22 functions without the presence of openings 23 in housing 40 because the holding elements 30 and 32 are capable of accepting a tool for storage. In another embodiment, housing 40 can be a one-piece construction. In still other embodiments, housing 40 can comprise more than two assembly pieces.

In the exemplary embodiment of FIG. 1, fishing rods 26 are shown stored vertically in storage device 20 comprising holder 22 and support apparatus 24. However, storage device 20 can also be utilized to store fishing rods 26 horizontally or in other orientations by positioning holder 22 and support apparatus 24 differently than represented by FIG. 1. Additionally, holder 22 can also be utilized to store tools, including fishing rods, with or without support apparatus 24. For example, in FIGS. 2-4, exemplary embodiments of holder 22 are shown without support apparatus 24. However, for fishing rods, it is preferred, but not required, that support apparatus 24 be used with holder 22.

In the exemplary embodiment shown in FIG. 1, support apparatus 24 comprises a top panel 72 and a bottom panel 74. Bottom panel 74 has a solid construction and is capable of providing support to the bottom portion 27 of rod 26. The number of openings 76 that top panel 72 defines is equivalent to the number of openings 23 that housing 40 defines. However, support apparatus 24 can take any form capable of providing additional support for the storage of a stored item, such as a fishing rod. For instance, support apparatus 24 can simply be a flat panel providing support to the bottom portion of the stored tool.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A device for storing tools such as fishing and hunting equipment, comprising:

a housing defining at least one opening;

a pair of holding elements located substantially within said opening, each said holding element being pivotally attached to said housing, said holding elements being movable between an open position and a closed position, wherein each of said holding elements define a stepped interlockable member configured to overlap with each other when said holding elements are in said closed position, wherein the interlockable members are shaped to allow said holding elements to move from said closed position to said open position upon the insertion of the tool; and a pair of biasing elements, wherein said biasing elements are in contact with said housing and said holding elements and are configured so as to urge said holding elements towards one another.

2. An apparatus for storing tools including sporting goods, comprising:

a housing defining at least one opening;

a first jaw member movably attached to said housing within said opening;

a second jaw member attached to said housing within said opening and positioned relative to said first jaw member so as to provide for the selective inserting or removal of the tool from between said first and second jaw members;

a first spring positioned to bias said first jaw member toward said second jaw member; and at least one tooth stepped on each of said jaw members, wherein said first and second jaw members are movable between an open position and a closed position and wherein said at least one tooth on said first jaw member overlaps said at least one tooth on said second jaw member in said closed position, wherein said at least one tooth is shaped to allow said jaw members to open upon insertion of the tool between said first and second jaw members.

3. An apparatus for storing fishing and hunting equipment, comprising:

a housing defining at least one opening;

a pair of holding elements located substantially within said opening, each said holding element being attached to said housing, said holding elements being movable between an open position and a closed position;

a pair of springs positioned in contact with said holding elements so as to force said holding elements towards one another within said opening; and one or more interlocking members stepped on each holding element such that the interlocking members overlap when said holding elements are in a closed position, wherein said interlocking members are shaped to allow said holding elements to move from said closed position to an open position upon the insertion of the equipment.

4. The device of claim 3, further comprising a means for securing said housing to a support structure.

* * * * *